United States Patent [19]

Thompson

[11] 4,267,679

[45] May 19, 1981

[54] INSULATED BUILDING PANEL WALL CONSTRUCTION

[75] Inventor: Leroy Thompson, Sewickley, Pa.

[73] Assignee: Steelite, Inc., Pittsburgh, Pa.

[21] Appl. No.: 13,910

[22] Filed: Feb. 22, 1979

Related U.S. Application Data

[63] Continuation of Ser. No. 754,756, Dec. 27, 1976, abandoned, which is a continuation-in-part of Ser. No. 556,632, Mar. 10, 1975, abandoned.

[51] Int. Cl.[3] ..... B44F 7/00; E04D 1/34; E04C 1/10; E04B 1/62

[52] U.S. Cl. ..... 52/311; 52/403; 52/406; 52/407; 52/478; 52/483; 52/580; 52/588; 52/545; 52/802; 52/805

[58] Field of Search ..... 52/802, 805, 403, 580, 52/529, 407, 478, 394, 582, 545, 483, 539, 588, 406, 570, 577, 316, 314, 311

[56] References Cited

U.S. PATENT DOCUMENTS

| | | | |
|---|---|---|---|
| 3,267,626 | 8/1966 | Daly | 52/145 |
| 3,290,845 | 12/1966 | Snyder | 52/588 |
| 3,300,934 | 1/1967 | Waizenhofer | 52/394 |
| 3,353,318 | 11/1967 | Bacher | 52/403 |
| 3,438,168 | 4/1969 | Tischuk | 52/478 |
| 3,469,873 | 9/1969 | Glaros | 52/588 X |
| 3,507,079 | 4/1970 | George | 52/74 |
| 3,535,844 | 10/1970 | Glaros | 52/802 |
| 3,564,800 | 2/1971 | Armitage | 52/539 X |
| 3,611,660 | 10/1971 | Costello | 52/314 |
| 3,667,180 | 6/1972 | Tischuk | 52/483 X |
| 3,759,007 | 9/1973 | Thiele | 52/545 X |
| 3,777,430 | 12/1973 | Tischuk | 52/483 X |
| 3,797,190 | 3/1974 | Widdowson | 52/403 X |
| 3,828,493 | 8/1974 | Vezmar | 52/483 X |
| 3,841,045 | 10/1974 | Criswell | 52/395 |

FOREIGN PATENT DOCUMENTS

| | | | |
|---|---|---|---|
| 560322 | 9/1957 | Belgium | 52/407 |
| 584649 | 10/1959 | Canada | 52/394 |
| 886809 | 11/1971 | Canada | 52/483 |
| 2033507 | 1/1972 | Fed. Rep. of Germany | 52/483 |
| 88656 | 1/1967 | France | 52/802 |
| 90081 | 8/1967 | France | 52/802 |

*Primary Examiner*—Leslie Braun

*Attorney, Agent, or Firm*—Webb, Burden, Robinson & Webb

[57] ABSTRACT

This invention is directed to an insulating panel wall construction comprising a plurality of hollow insulated construction panels. The construction panels are fabricated from opposed interior and exterior sheet metal sections secured together through yieldable insulating gaskets. Together the sections define a panel having interior and exterior walls and opposite inter-engaging panel edges. One of said edges is provided to receive fasteners for securing the panels to standards. The panel edges have inter-engaging configurations such that exterior metal sections abut only exterior metal sections and interior metal sections abut only interior metal sections. Exterior sheet metal sections alone may be used to form a panel wall as they have inter-engaging edges.

9 Claims, 8 Drawing Figures

INSULATED BUILDING PANEL WALL CONSTRUCTION

PRIOR APPLICATIONS

This application is a continuation of application Ser. No. 754,756, filed Dec. 27, 1976 which was a continuation-in-part of application Ser. No. 556,632, filed Mar. 10, 1975, both now abandoned.

THE INVENTION

This invention is directed primarily to an insulated panel wall construction for the exterior of buildings. However, the construction described has utility for interior walls. A typical technique for applying panels or facings to a building wall has been to secure panels directly to the structural members or girts of the building with an intermediate layer of an insulating material. This construction has a serious drawback; namely, the insulating material being crushable does not permit a suitably rigid fastening between the panel and the supporting structures. Another construction for building walls comprises insulated double walled sheet metal panels. In some instances, this is an improvement over the previously described prior art construction, however, the insulated double walled sheet metal construction panels may have several drawbacks.

Double walled sheet metal panels, according to this invention, have the following combination of advantages and individual advantages. The panels are constructed of exterior and interior metal sections that make no metal to metal contact even when the edges of the panels are inter-engaged with adjacent panels. This substantially reduces the heat losses through the panels by conduction. The panels may be secured to structural members with fasteners that pass through and hold both interior and exterior sheet metal sections. Also, the panels are of a tongue and groove type construction wherein the bearing surfaces holding the fastened edge of a panel against the unfastened edge of an adjacent panel are located to each side of the fastener. The interior and exterior sheet metal sections may be identical eliminating the necessity for two production lines. These features enable the rigid and positive attachment of the panels to the supporting structure. Panels according to this invention have the further advantage that relative movement between the front and back sheet metal sections is accommodated by novel attachment means therebetween. In this way, strain in the external wall due to thermal expansion or contraction is not transferred to the interior wall or the supporting structure. It is yet another advantage that the wall construction according to this invention may be decorated with feature strips having a novel engagement means with the inter-engaging edges of adjacent panels which does not require alteration of the standard panel.

The basic unit of insulating wall construction according to this invention is a hollow insulating construction panel. The panel is comprised of two sheet metal sections. Together the sections define a panel having interior and exterior walls and inter-engaging panel edges. The interior and exterior sheet metal sections are secured together through yieldable insulating gaskets. One edge of each panel is provided to receive fasteners and is hereinafter referred to as the fastener edge. The edges have a generally S-shaped central section with offset peripheral faces extending therefrom to the interior and exterior walls of the panel. The protruding, generally U-shaped lobes of the S-shaped section define tongues. The intruding, generally U-shaped lobes define sockets for receiving the tongues of adjacently positioned panels. The tongue and socket on each edge of the panel are integral with opposed sheet metal sections. Sheet metal sections have a tongue on one edge and a socket on the other. The sockets have a joining flange extending therefrom which is partially extended into the interior of the tongue on the opposed sheet metal section. Gaskets are snugly fit therebetween. The offset faces on the fastened edge of the panel are arranged such that the face joining the interior wall or base and the adjoining tongue extend farther from the central portion of the panel than the other peripheral face. In this way, a fastener can be aligned between the offset faces extending through both of the exterior and interior metal sections. The end faces on the unfastened edge of the panel are offset to accommodate the offset faces on an adjacent fastened edge.

Preferably, at least one gasket well is provided on at least one of the side faces on each panel edge. In this way, strip gaskets can be inserted in the wells providing an airtight seal between panels. It should be understood that the exterior sheet metal sections can have any one of a number of decorative ornamental configurations. It is also preferable according to this invention to provide a well in the joining flange on the fastening edge to accommodate the head of a fastener.

Wall constructions according to this invention comprise a plurality of spaced standards with horizontal girts fastened thereto defining a framework to which are secured a plurality of hollow insulating construction panels as described above. The panels are secured at their fastened edges to the girts and each of the panels is inter-engaged by the adjacent panels to form a continuous insulated wall. Preferred wall construction according to this invention comprises, in addition, at least one feature strip secured to the face of the panels. A feature strip according to this invention comprises sheet metal or extruded metal shaped to define an ornamental surface with edge walls extendng therefrom. A securing flange terminating in a hook or an offset is joined to at least one edge wall. The securing flange and hook substantially conform to the shape of the exterior section of the unfastened edge of the panel. In this way, the securing flange or hook is positionable between the inter-engaging edges of the panels for securing the feature strip to the face of the wall construction. It is not necessary, however, it may be preferable, to use additional fasteners or adhesives to hold the feature strip to the face of the wall construction. Furthermore, because of the transverse movement provided between the external sheet metal sections and the internal sheet metal sections of hollow panels according to this invention the feature strips may be incorporated into the wall constructions using standard panels. In other words, it is not necessary to change the dimensions of the panel in order to accommodate the additional thickness of the securing flange of the feature strip inserted between the inter-engaging edges of the adjacent panels.

Further features and other objects and advantages of this invention will become apparent to one skilled in the art from a study of the following detailed description made with reference to the drawings, in which.

Figure 1:
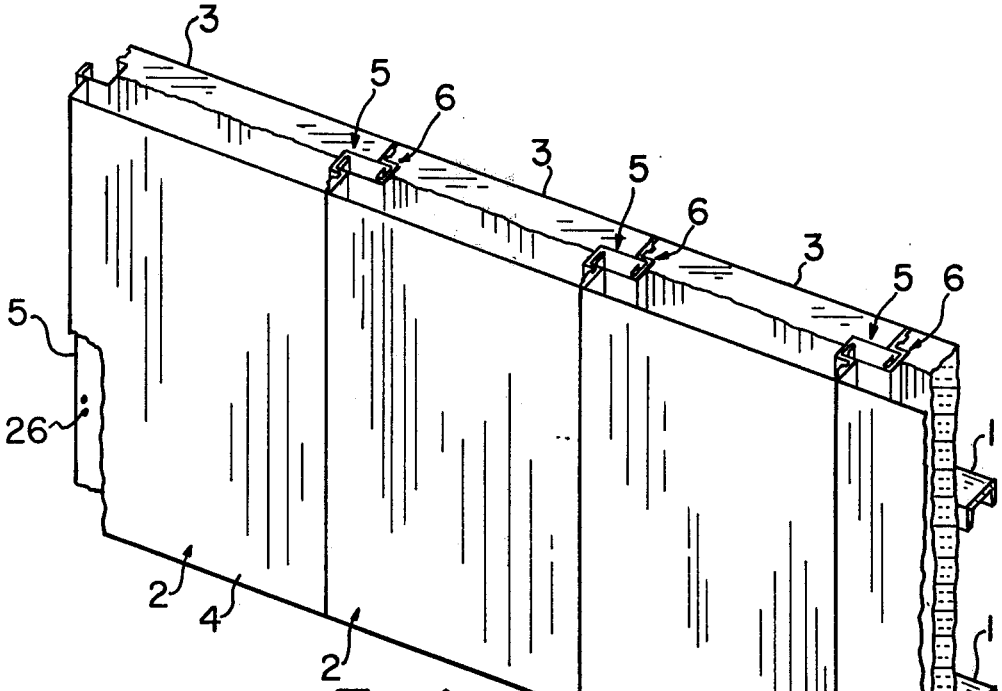
FIG. 1 is an overall pictorial view of an insulating panel wall construction according to this invention.
Figure 2:
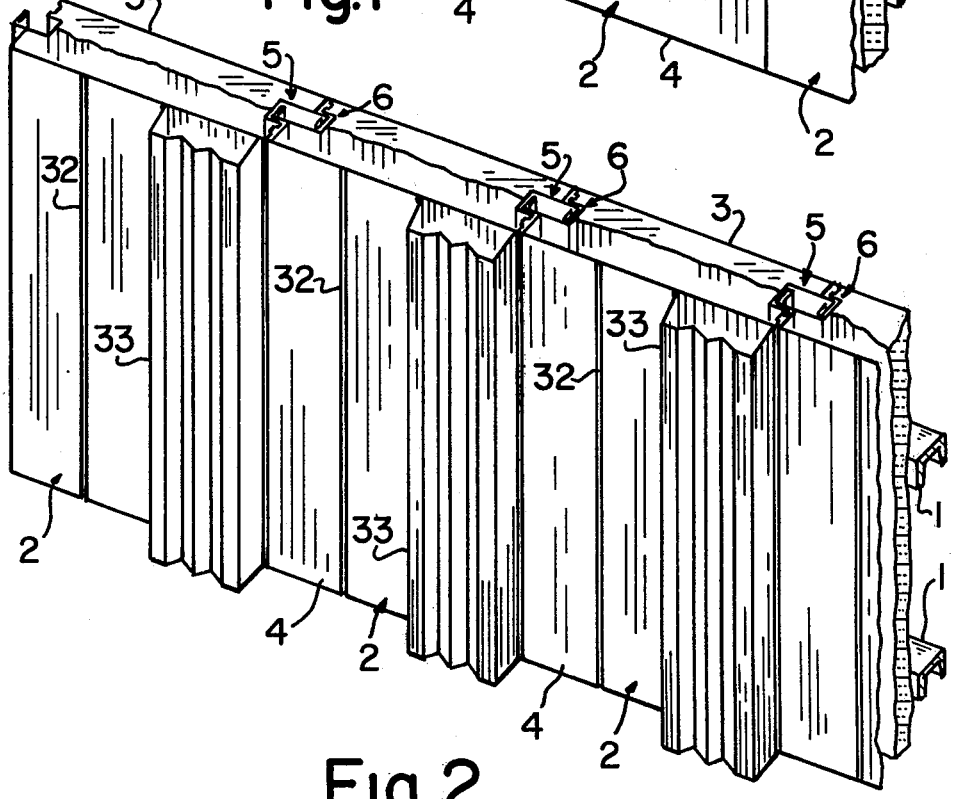
FIG. 2 is a pictorial view of an insulating wall construction incorporating feature strips according to this invention.

Referring now to FIG. 1 insulating wall constructions according to this invention comprise a plurality of space girts 1. It should, of course, be understood that the girts may either be horizontal or vertical. They are, however, generally horizontal as shown. Secured to the girts are panels 2 having internal faces 3, external faces 4 and inter-engageable edges 5 and 6. The panels are secured at one edge to the girts by suitable fasteners such as screws or bolts 26. FIG. 2 shows an alternate embodiment of this invention wherein feature strips having ornamental faces 33 are secured to the face of the wall construction by flanges that are inserted between inter-engaging edges of the wall panels.

Figure 3:
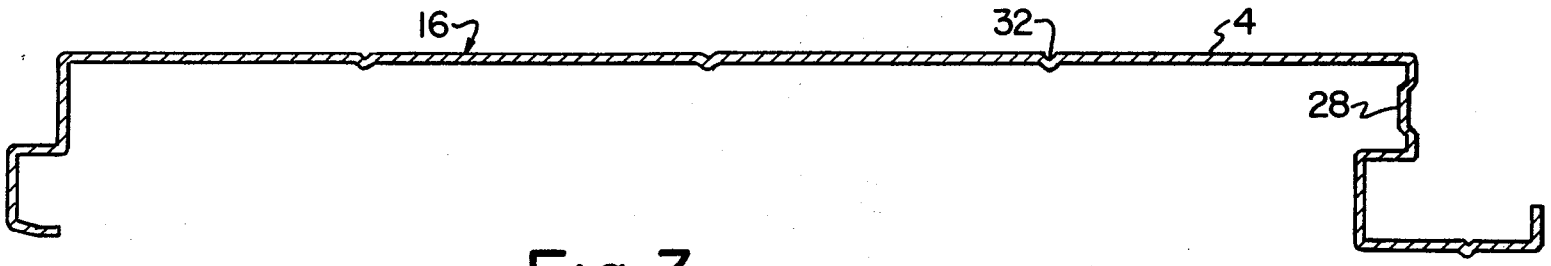
FIG. 3 shows an embodiment of exterior sheet metal sections for insulating panels according to this invention.

Referring now to FIG. 3, it is permissible according to this invention that the exterior sheet metal sections 16 have ornamental configurations. Longitudinal beads 32 may add decoration to flat areas of panels such as shown in FIG. 3 and at the same time provide additional rigidity to the panels.

Figure 4:
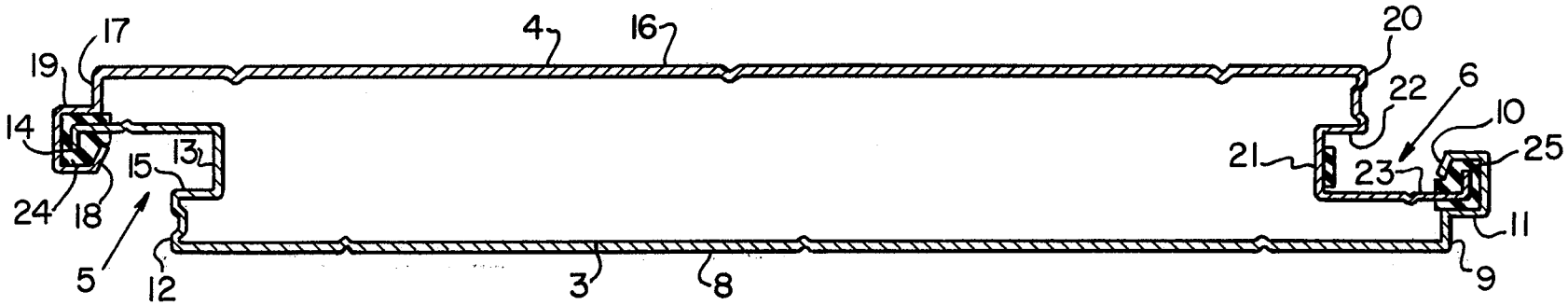
FIG. 4 is a section view of an insulating panel according to this invention.

Referring now to FIG. 4, insulating panels according to this invention are constructed from two sheet metal sections (8, 16). Together the sections define a panel having interior 3 and exterior 4 walls and inter-engaging edges. One edge 6 is adapted to be fastened to the girts as described above and the other edge 5 is held in place by inter-engaging a fastened edge.

The interior section 8 has a base or internal face 3 and an end face 9 joining the base near the fastened edge and forming an angle therewith. A generally U-shaped socket 10 opening toward the panel is joined to the end face 9. The exterior surface 11 of the socket 10 which is generally parallel to the base 3 and facing in the same direction is a bearing surface as hereinafter explained. Near the unfastened end of the interior section the base is joined by an end face 12 which in turn is joined by a generally U-shaped socket 13 opening away from the panel. Extending from the socket is a joining flange or tongue 14. The exterior surface of the socket 15 which is generally parallel to the base 3 and facing in the same direction is a bearing surface. The exterior sheet metal section 16 has a substantially similar configuration to the interior sheet metal section and preferably may be identical therewith. The exterior section has an exterior face 4 and an end face 17 joining therewith near the unfastened edge at one end. A generally U-shaped socket 18 joins the end face 17. The surface 19 on the socket 18 which is generally parallel to the base 3 and facing in the same direction is a bearing surface. An end face 20 joins the exterior face 4 near the fastened edge. A generally U-shaped socket 21 is secured to end face 20 and has a bearing surface 22 substantially parallel to the base 3 and facing in the same direction. Extending from the socket is a joining flange or tongue 23.

The opposed sheet metal sections are secured together by inserting respective joining tongues 14 and 23 partially into the respective sockets 18 and 10. Gaskets 24 and 25 are snugly positioned between said sockets and tongues. This fastening arrangement permits a small amount of movement of the sheet metal sections 8 and 16 relative to each other. It can be seen that the central portion of the edge of the panel is generally S-shaped. The end faces 17 and 12 extending therefrom are offset. It should be understood that the U-shaped tongues and U-shaped sockets may without deviating from the scope of the invention be curvilinear or rectangular. They must, of course, be complementary to the extent hereinafter explained. Numerous flexible rubber like materials, for example, neoprene, can be used as gaskets (24 and 25).

Figure 5:
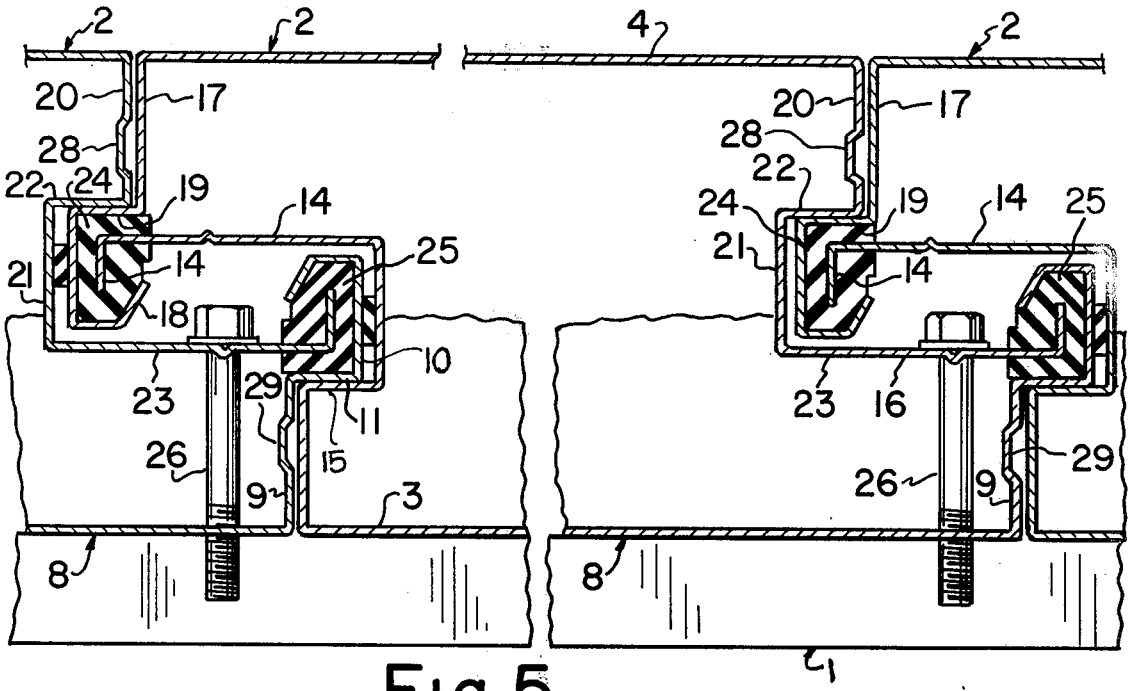
FIG. 5 is a section view of yet another embodiment of this invention. The adjacent inter-engaging panels are shown.

Referring now to FIG. 5, an insulating panel according to this invention is shown in relation to adjacent inter-engaged insulating panels. The bearing surfaces 11 and 22 on the fastened edge of a panel abut the bearing surfaces 15 and 19 respectively of the inter-engaging unfastened edge of an adjacent panel. The bearing surfaces are spaced to each side of the fastener resulting in a better distribution of the stresses exerted by the panels upon each other. While the bearing surfaces in FIG. 5 have been shown as planar and substantially parallel to the base 3, it should be understood that other surfaces not parallel to the base are contemplated by this invention.

The offset end faces 9 and 20 at the fastened edge of the panel are arranged such that the end face 9 integral with the interior section 8 is farther from the central portion of the panel than the end face 20. In this way, a fastener 26 aligned between the offset faces can be inserted through both the external sheet metal section 16 and the internal metal section 8 for securing the panel to a girt 1. Preferably, a fastener having a head and a shoulder is used such that the head holds the external section and a shoulder holds the internal section against the girt.

While it is desirable that the inter-engaging edges be substantially complementary, that is, having abutting bearing surfaces and abutting peripheral or side faces, they must provide for the head of the fastener 26. They may also provide for various sealing devices. According to a preferred embodiment of this invention, the joining flange has a well therein for accommodating a head of the fastener. According to yet another preferred embodiment of this invention, at least one end face at each edge of the panel has a siphon break 28 to allow any water which might seep into the junction between the inter-engaged panels to drop down rather than to go on through the panel wall.

FIG. 5 illustrates one of the primary advantages of panel construction according to this invention; namely, that when the edges of the panel are inter-engaged, exterior sections abut only exterior sections and interior sections abut only interior sections. Thus, there is no metal to metal contact between the exterior and interior sections. This greatly enhances the insulating capabilities of the hollow panel. When feature strips are inserted between inter-engaging edges according to this invention, they do not cause metal to metal contact between exterior and interior sections.

FIG. 5 is a section view of two adjacent inter-engaging panels in which the sockets 10 and 18, the tongues 14 and 23 and the gaskets 24 and 25 have an angular configuration which ensures that the inner 3 and outer 4 panels cannot be easily separated from each other. The ends of the sockets 10 and 18 are bent around the gaskets 25 and 24 respectively, after the inner and outer panels have been assembled together, thus preventing horizontal disengagement of the panels.

Figure 6:
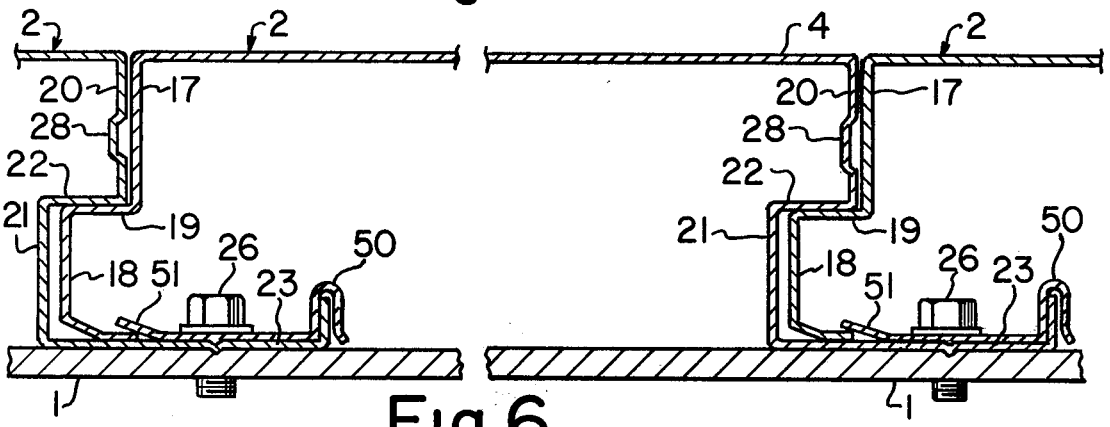
FIG. 6 is a section view of a single section panel wall construction. The adjacent interengaging panels are shown.

FIG. 6 illustrates how individual panels 4 may be used to construct a wall by fastening the panels to a superstructure 1 with fasteners 26.

A preferred feature is shown in FIG. 6. Clip 50 is designed to fit over edge 23 and to be held by fastener 26. Free end 51 provides additional fastening of the unfastened edge of the panel, thereby securing the edge of the panel and prevents it from disengaging.

The interior and exterior panel sections may be made from any suitable material which is capable of being formed to the configurations described. It is preferred that the panels be stamped or continuously roll-formed out of light gauge sheet metal such as galvanized steel, aluminum, stainless steel, or aluminized steel. To resist corrosion and to add decoration such as color, the steels may be coated, for example, with vinyl or silicon polyester or other coatings or films. Suitable materials include 18 to 24 gauge aluminum and stainless steel, 18 to 24 gauge aluminized steel and carbon steel, electro-zinc coated and painted and other types of sheet materials.

Any suitable insulation can be incorporated into the panels as described, for example, fiber glass insulation, polystyrene insulation, foamed insulations or others which may be available. The insulation may be in the form of bats laid in place before the interior and exterior sheet metal sections are joined. On the other hand, the insulation may be a foam resin placed into the assembled panel and allowed to expand and solidify in situ or a combination of the two. It should be understood that other insulating techniques are available and useful in this invention.

Figure 7:
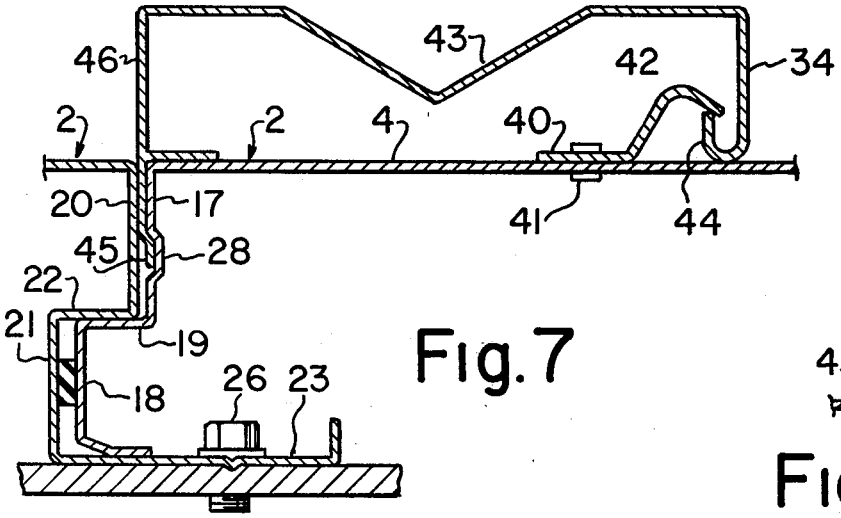
FIG. 7 is a section view through two inter-engaging panel strips and a feature strip having a novel snap on construction.

FIG. 7 is a cross sectional view of a panel wall construction having a feature strip. The feature strip is a sheet metal or extruded shape defining an ornamental surface 43 and having edge walls 34 and 46 extending away therefrom to support the feature strip away from the face of the panels. The edge wall extension substantially conforms to the shape of the exterior section of the edge of a panel. In this way, the securing flange and hook can be inserted between the inter-engaged edges as shown.

Because of the novel manner in which the exterior section and interior section are joined through yielding gaskets, there is sufficient lateral movement between the exterior and interior sections so that the thickness of the edge wall extension of the feature strip can be accommodated. In other words, all hollow panels may be standardized whether or not they are used with feature strips. This is indeed an important advantage of this invention.

FIG. 7 further illustrates a technique for securing feature strips. A guide strip 40 is fastened, for example, by rivets 41 or other fastening devices to the face of the outer panel. The guide strip has a hook-shaped edge 42 which may have a slight spring action. The feature strip 43 has a complementary hook-shaped edge 44 for engaging the guide strip. With the face of the feature strips substantially perpendicular to the face of the panel, the edge of the feature strip may be slid under the guide strip. Then, the feature strip is rotated such that its face becomes substantially parallel to the face of the panel. During rotation the edge of the feature strip is wedged against the panel face due to the configuration of the elements as shown in the drawing. After sufficient rotation, the feature strip snaps into place as the offset 45 in the securing flange 46 of the feature strip enters the siphon break 28 on the unfastened end of panel 4.

Figure 8:
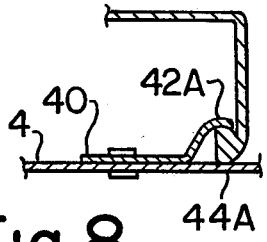
FIG. 8 is a section view of another embodiment of a feature strip snap construction.

FIG. 8 illustrates a manner of securing feature strips similar to that illustrated in FIG. 7. The feature strip 43 has a complementary edge 44A for engaging the hook-shaped edge of 42A of guide strip 40. The complementary edge 44A has a cord shaped cross section. The feature strip is integral with the complementary edge and more or less tangent to the curved surface of the complementary edge.

The use of feature strips as described results in a decorative yet not prohibitably expensive panel wall construction. While the exterior sections of the panels may be variously shaped, it should be apparent that the width of the sheet metal used to fabricate these sections is greater than that used to fabricate less complicated sections. It is a considerable savings to the manufacturer of these panels that the panel sections can all be fabricated from a sheet metal strip of a uniform width. By using the feature strips to add the ornamental relief, the panels may have a uniform and simple cross section.

The feature strips may be painted different colors than the panels to achieve various pleasing appearances. The use of multiple tone decorations may be very expensive, where more than one color is painted on a single panel section. But the same if not a superior effect is achieved by coloring the panels and feature strips differently. In this way, it is not necessary to apply two colors to the same item which is a costly and time consuming process.

Having thus described the invention with the detail and particularity as required by the Patent Laws, what is claimed and desired to be protected by Letters Patent is set forth in the following claims:

1. A wall construction comprising:

a. a plurality of spaced girts defining a framework, b. a plurality of hollow insulating construction panels comprising opposed interior and exterior sheet metal sections secured together through yieldable insulating gaskets, said sections together defining interior and exterior walls and opposed inter-engaging panel edges, one of said edges provided to receive fasteners, said edges having generally S-shaped central sections, said panel edges having peripheral faces extending between said S-shaped central sections and said walls, said panels secured at their fastening edge to said girts, each of said panels inter-engaging the adjacent panel to form a continuous insulating wall; and, c. at least one feature strip comprising an ornamented surface, said feature strip secured to the face of said wall by means positionable between the interengaging edges of said panels.

2. A wall construction according to claim 1 wherein the feature strip for use in the inter-engaging panel wall construction comprises a guide strip with a hook-shaped end fastened to the outer panel comprising an ornamental surface. edge walls extending therefrom, one of said edge walls terminating in a hook adapted to engage the hook-shaped end of the guide strip and the opposed edge wall adapted to be positioned between the inter-engaging edges of said panels.

3. A wall construction according to claim 2 in which one of the edge walls of the feature strips terminates in a cord-shaped cross-section.

4. A wall construction according to claim 1 in which said feature strip comprises means for supporting the ornamental surface away from the exterior surface of the panels in cooperation with said means positioned between the inter-engaging edges of the panels.

5. A wall construction according to claim 1, in which the feature strip comprises edge walls extending from the ornamental surface and forming an angle therewith, a means positionable between the inter-engaging walls of said panels for securing the feature strip to the face of said wall construction, said securing means extending directly from one of said edge walls, the angle between said edge wall and said ornamental surface disposed to bias the opposite edge wall against the exterior panel surface.

6. In a hollow panel comprising opposed interior and exterior sheet metal sections, said panel having a fastened edge arranged to be secured by fasteners to a wall, ceiling or the like, and an unfastened edge, the improvements comprising:

a. said interior section having
   i. a base,
   ii. a first end face joining said base near the fastened edge and forming an angle therewith,
   iii. a generally cup-shaped portion opening toward the panel interior having a bearing surface generally parallel to said base and joining said first end face, said cup-shaped portion terminating in a flange which extends toward the plane of the base,
   iv. a second end face joining said base near the unfastened edge forming an angle therewith,
   v. a generally U-shaped socket opening away from the panel interior and joining said second end face, said socket having a bearing surface generally parallel to the base and,
   vi. a tongue extending outwardly from said socket substantially parallel to the plane of said base and terminating in a flange which extends toward the plane of the base;

b. said exterior section having
   i. an exterior face,
   ii. a first end face joining said exterior face near the unfastened edge forming an angle therewith,
   iii. a generally cup-shaped portion having a bearing surface generally parallel to the base joining said first end face, said cup-shaped portion terminating in a flange which extends toward the plane of the exterior face,
   iv. a second end face joining said exterior face near the fastened edge forming an angle therewith,
   v. a generally U-shaped socket having a bearing surface substantially parallel to the base joining said second end face,
   vi. a tongue extending outwardly from said socket substantially parallel to the plane of said exterior face and terminating in a flange which extends toward the plane of the exterior face;

c. yieldable gaskets snugly positioned within said cup-shaped portions enclosing the flanged end of said tongues to secure together the opposed sections, the flanged end of said cup-shaped portions extending toward the flanged end of said tongues such that said cup-shaped portions are wrapped about said gaskets and flanged end of said tongues sufficiently to prevent relative lateral movement of said opposed sections, the aforesaid opposed sections and gaskets forming said hollow panel, such that the edges are arranged to snugly abut the bearing faces on an adjacently positioned panel and such that exterior metal sections abut only exterior metal sections and interior metal sections abut only interior metal sections.

7. The improvements according to claim 6 wherein the first end face joining said base at the fastened end thereof, and the second end face joining said exterior face at the fastened end thereof are offset and said first end face joining said base is further from the center of the panel than the second end face joining said exterior face, whereby a fastener aligned between the offset faces may be extended through both the exterior and interior sections for positively securing both interior and exterior sections of the panel to a girt.

8. The improvement according to claim 7 wherein at least one siphon break is provided on at least one end face on each edge.

9. The improvement according to claim 8 wherein a well is disposed in the flanged tongue on the fastened edge for accommodating the head of a fastener.

* * * * *

UNITED STATES PATENT AND TRADEMARK OFFICE

CERTIFICATE OF CORRECTION

PATENT NO. : 4,267,679

DATED : May 19,1981

INVENTOR(S) : Leroy Thompson

It is certified that error appears in the above-identified patent and that said Letters Patent are hereby corrected as shown below:

Column 2 Line 42 "extendng" should read --extending--.

Column 6 Line 39 Delete --claimed and--.

Claim 2 - Column 6 Line 64 "." should read --,--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*